US007658592B1

(12) United States Patent
Jarrah et al.

(10) Patent No.: US 7,658,592 B1
(45) Date of Patent: Feb. 9, 2010

(54) SLOTS IN FAN HOUSING TO REDUCE TONAL NOISE

(75) Inventors: Yousef Jarrah, Tucson, AZ (US); John Herzberger, Tempe, AZ (US)

(73) Assignee: Minebea Co., Ltd., Tokyo (JP)

( * ) Notice: Subject to any disclaimer, the term of this patent is extended or adjusted under 35 U.S.C. 154(b) by 381 days.

(21) Appl. No.: 11/640,057

(22) Filed: Dec. 14, 2006

Related U.S. Application Data

(60) Provisional application No. 60/755,474, filed on Dec. 29, 2005.

(51) Int. Cl.
*F03B 11/04* (2006.01)

(52) U.S. Cl. ..... 415/119

(58) Field of Classification Search ..... 415/119, 415/177, 914; 416/93 R
See application file for complete search history.

(56) References Cited

U.S. PATENT DOCUMENTS

| | | | | |
|---|---|---|---|---|
| 4,086,022 | A * | 4/1978 | Freeman et al. | 415/119 |
| 5,409,352 | A * | 4/1995 | Lin | 415/177 |
| 5,896,917 | A | 4/1999 | Lemont et al. | |
| 6,773,239 | B2 | 8/2004 | Koczo | |
| 7,210,905 | B2 * | 5/2007 | Lapworth | 415/220 |

* cited by examiner

*Primary Examiner*—Edward Look
*Assistant Examiner*—Dwayne J White
(74) *Attorney, Agent, or Firm*—Townsend and Townsend and Crew LLP

(57) ABSTRACT

A fan housing is provided with slots formed in the enclosure of the fan housing. The slots are sized appropriately to filter the noise generated during operation of the cooling fan; e.g., tonal noise produced by the rotation of the blades. The slots may either be vented to the outside of the enclosure or closed off.

18 Claims, 4 Drawing Sheets

SLOTS IN FAN HOUSING TO REDUCE TONAL NOISE

CROSS-REFERENCES TO RELATED APPLICATIONS

The present application claims priority from U.S. Provisional Application No. 60/755,743, filed Dec. 29, 2005, and is fully incorporated herein by reference for all purposes.

BACKGROUND OF THE INVENTION

The present invention relates to cooling fans and in particular to a fan housing configured to reduce noise in a cooling fan.

The prior art for fans includes a housing and a fan assembly. The fan assembly fits into an air passage region provided in the housing. The fan assembly includes an impeller unit and a motor for driving the impeller unit. The housing typically comprises a base to which the motor is attached and an enclosure (or casing).

A common problem with fans is the noise they generate during operation. A particularly displeasing noise component is tonal noise. Tonal noise is a result of the rotation of the fan blades. The frequency spectrum of tonal noise comprises largely of components (fundamental and harmonics) of the blade passing frequency, which is the number of fan blades times the shaft speed (revolutions per second). Broadband noise is another noise component, but is less noticeable as compared to tonal noise since its frequency spectrum is generally much broader that the frequency spectrum of tonal noise and the amplitudes of its frequency components are lower.

BRIEF SUMMARY OF THE INVENTION

Embodiments of the present invention provide a fan housing having slots in the enclosure (casing) of the fan housing. The slots are sized appropriately to filter the noise generated during operation of the cooling fan; e.g., tonal noise produced by the rotation of the blades. The slots may either be vented to the outside of the casing or closed off.

Sizing the width of the slots to match with the frequencies of the noise is an important consideration. Typically, a larger number of slots (slot count) is preferred (limited by manufacturing costs), and smaller sized slot widths are preferred (also limited by manufacturing costs). Generally, the dimensions of the slot (volume, area, etc.) and slot count are dependent on the blade passing frequency.

In one embodiment, the slots are provided in the corner regions of the fan housing enclosure. In other embodiments, the slots may be filled with sound-absorbing material.

Additional noise reduction can be achieved by providing noise suppression. For example, the corner regions can be provided with noise-suppressing devices or materials to interact with noise due to rotation of the blades to weaken and/or cancel the noise. The corners can be constructed of noise absorbent material.

Studies have shown substantial reduction in noise during fan operation with no adverse affects in fan performance such as pressure and flow.

DETAILED DESCRIPTION OF THE INVENTION

Figure 1:
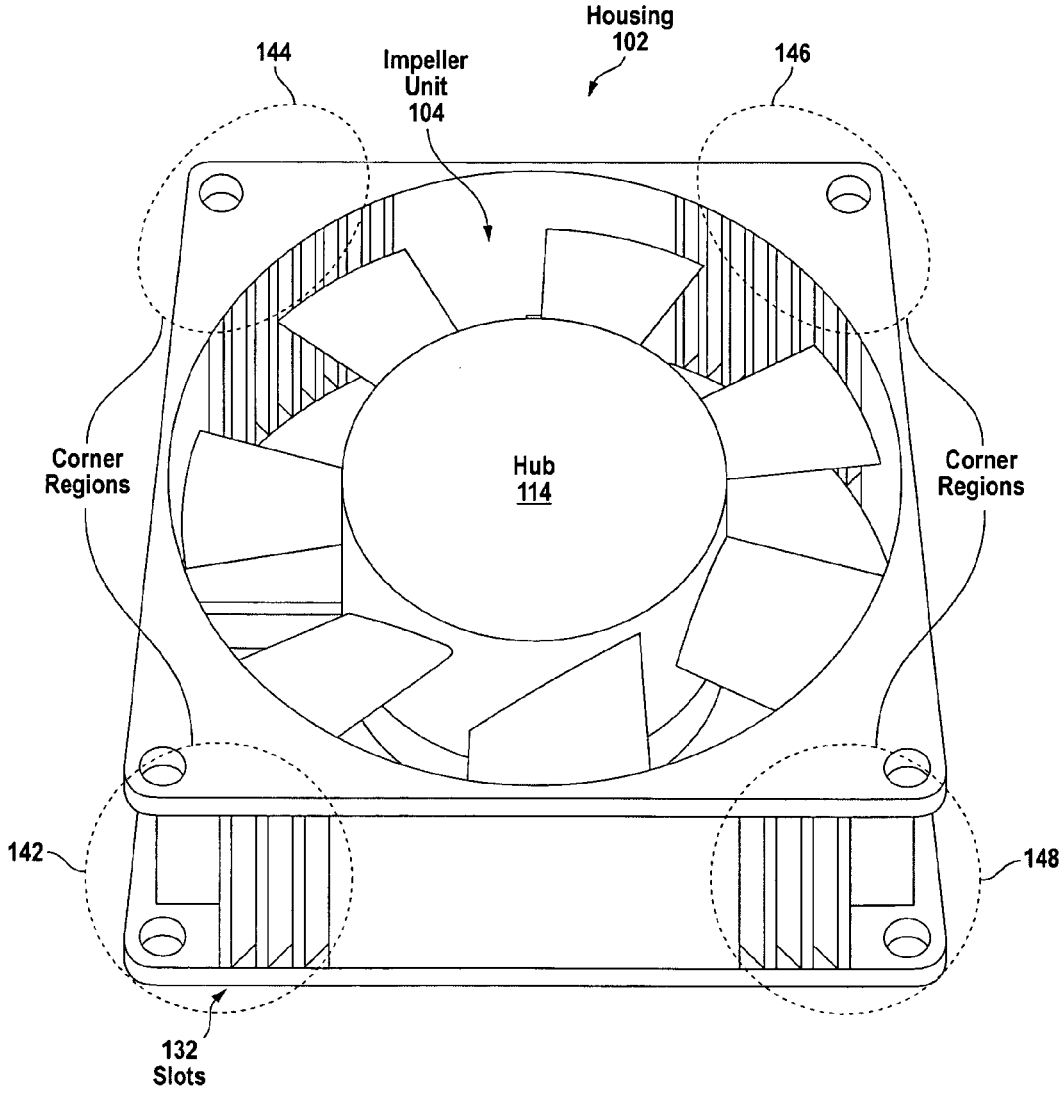
FIGS. 1 and 1A illustrate a fan and fan housing according to the present invention.
Figure 1A:
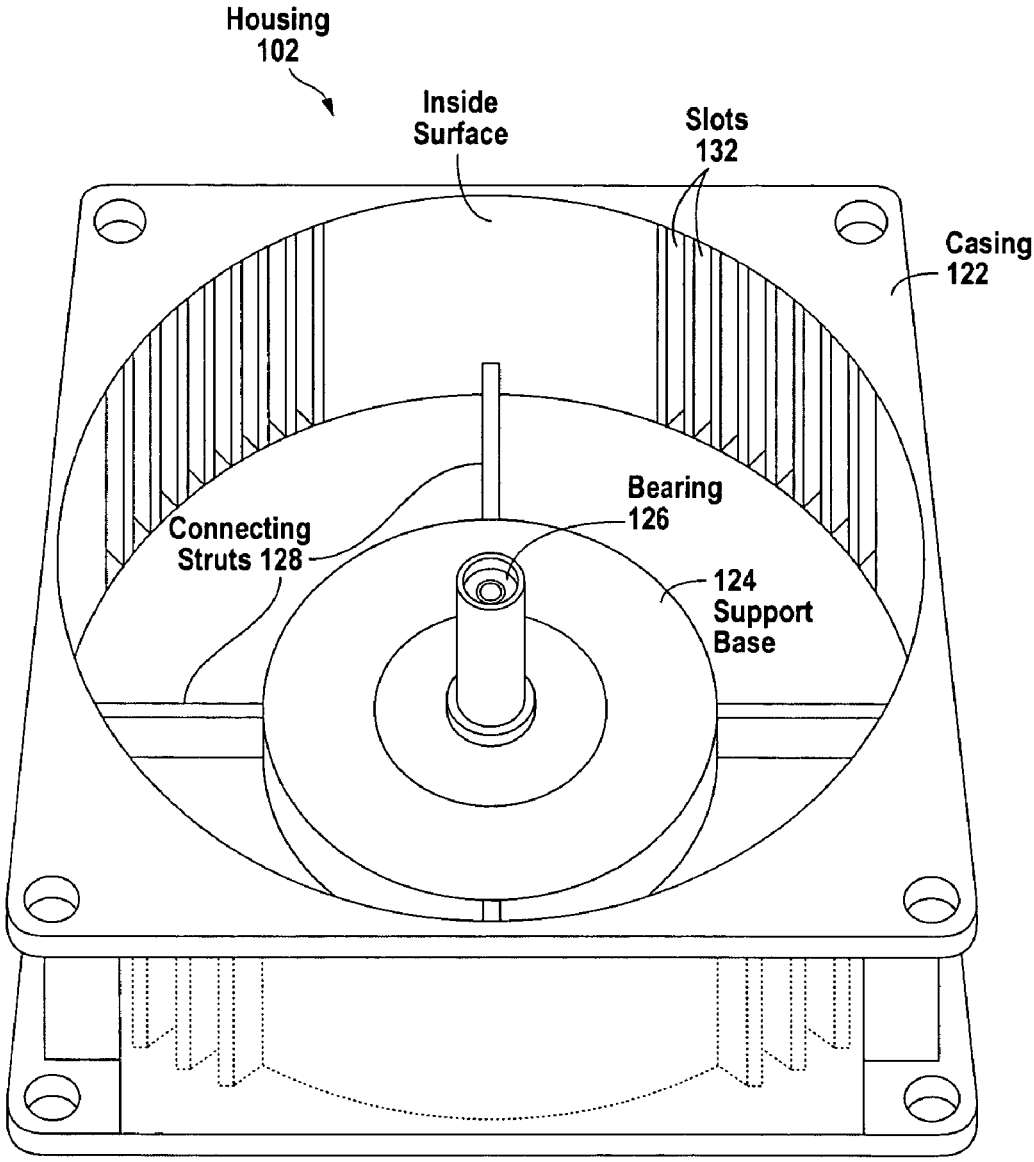

FIG. 1 shows a perspective view of a cooling fan according to an illustrative embodiment of the present invention. A fan housing 102 houses an impeller unit 104 which includes a set of fan blades 112 connected to a hub 114. The hub 114 houses a fan motor (not shown). FIG. 1A shows the fan housing 102 without the impeller unit. The fan housing 102 comprises an enclosure (casing) 122 which encloses the fan blades. The fan motor is supported on a supporting base 124 of the fan housing 102. An axle bearing 126 provided on the supporting base 124 provides a bearing surface on which a rotor component of the fan motor rotates. The supporting base 124 is connected to the enclosure 122 via connecting struts 128.

In the illustrative embodiment of the fan housing 102 shown in FIGS. 1 and 1A, the enclosure 122 is provided with vertically oriented features 132 which are slotted openings formed through the interior surface of the enclosure. In the embodiment shown, these vertically oriented features are vertical slots provided through the interior surface of the enclosure 122.

In FIG. 1, the slots 132 are exposed to the exterior of the enclosure 122. However, it was shown through experimentation that forming slots (see FIG. 2, for example) which did not pass through the exterior surface of the casing provided improved noise reduction. Nonetheless, slots which are vented to the outside of the enclosure can provide some noise reduction.

In the particular embodiment shown in FIG. 1, a set of slots 132 are provided in each of the corner regions 142-148 of a rectilinear housing 102. However, in other embodiments, fewer than all of the corners can be provided with vertical slots. For example, a fan according to one embodiment of the present invention may comprise a housing enclosure in which diagonally opposed corners (e.g., 142, 146) are provided with slots. A fan according to another embodiment of the present invention may comprise a housing enclosure in which an adjacent pair of corners are provided with slots (e.g., 142, 144). In accordance with another embodiment, slots may be provided in only one corner of the housing enclosure.

In still other embodiments, the slots can be provided on the interior surface along the side regions of the enclosure. For example, the housing 102 shown in FIG. 1 is rectilinear. For a circular-shaped housing, there are no "corner regions;" however, the slots can nonetheless be provided through the interior surface of the enclosure.

FIG. 1A illustrates an embodiment in which the slots are closed off form the exterior. Here, the slots are shown in phantom to indicated that they do not penetrate through the exterior surface of the casing (enclosure) 122.

Figure 2A:
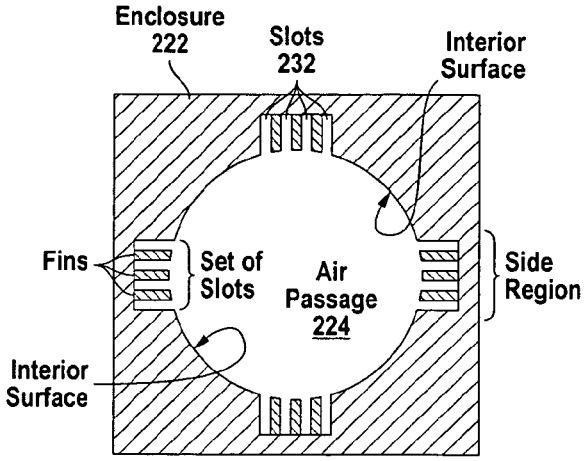
FIGS. 2A and 2B illustrate top cutaway views of a fan housing according to the present invention.

The schematic drawing of FIG. 2A illustrates an example of such an embodiment. The figure is a cutaway view of an enclosure 222 of a fan housing viewed from the top. The figure shows the air passage region 224 within which an impeller unit is disposed and within which the fan blades of the impeller unit rotate causing air to flow through the air passage. The interior surface of the enclosure 222 defines the air passage region 224. Fins 234 formed within the interior surface of the enclosure define slots 232 which is the spacing between fins.

Slots 232 are defined as the space between fins, and the dimensions and shapes of the slots are defined by the dimensions and shapes of the fins 234 and the spacing between the fins. In one embodiment, the size and spacing of all slots 232 may be uniform. However, it will be understood that the slot dimensions and shape may vary so that the slots are not uniformly formed or spaced.

The embodiment of FIG. 2A shows a set of slots formed in side regions of the interior of the enclosure 222, rather than at the corner regions. Fins 234 are formed on the interior surface of the enclosure. In one embodiment, the fins are formed from the material of the enclosure; for example by casting. Alternative embodiments include only one set of slots formed on one side region; one set of slots formed on one side and another set of slots formed on an opposing side or on an adjacent side; slots formed in the corner regions and in the side regions.

FIG. 2A further illustrates that the slots 232 are not formed through the enclosure 222 to the exterior of the enclosure (similar to FIG. 1A), the slots are closed off from the exterior. This was shown to provide greater noise reduction than if the slots were formed through the enclosure as illustrated by the embodiment shown in FIG. 1.

Figure 2B:
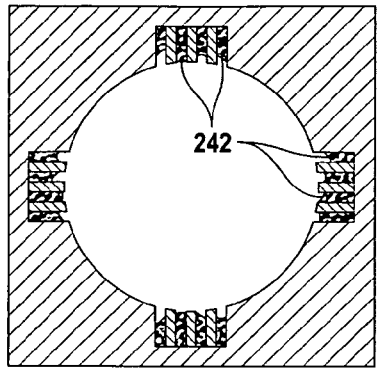

The slots 232 can be filled with noise reduction material 242 (e.g., foam, cotton batting). FIG. 2B illustrates this aspect of the present invention. The noise reduction material 242 can be provided in each slot 232, or in some of the slots. The noise reduction material can fully fill a slot, or can partially fill a slot. An alternative to the use of noise reduction material is the formation of a web-like structure within the slots 232 which act to dissipate the noise. Furthermore, the regions in the corner may house noise suppressing material (e.g., foam, cotton) or devices for further noise reduction.

The fins 234 may be formed of the same material as the enclosure. This would be advantageous from the point of view of manufacturing where the fan housing can be cast in a single step from a die by injection molding. Alternatively, the material for the fins 234 may be different from that used to produce the fan housing. This would allow for the use of sound absorbent material to improve noise reduction. In addition, a noise absorbent material can be used to construct or manufacture the corner portions of the housing, or the noise absorbent material can be embedded in the corner portions. Typical noise absorbent materials include cotton batting, foam, and the like.

Still other embodiments include a combination of FIGS. 1 and 2, where slots can be provided in the corner regions and in the side regions. An additional benefit of having additional slots is to further reduce the weight of the cooling fan.

Figure 3A:
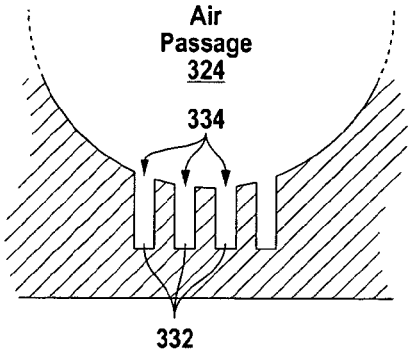
FIGS. 3A to 3C illustrate variations in slot design according to various embodiments of the present invention.
Figure 3B:
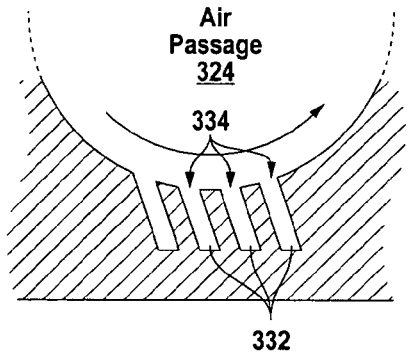
Figure 3C:
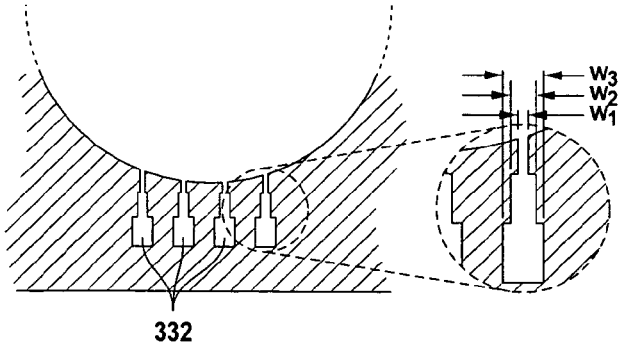

FIGS. 3A-3C show alternative configurations of slots in accordance with the present invention. The view is a cutaway top view of an enclosure 322 of a fan housing, looking down. A portion of the air passage region 324 is shown to provide perspective. The slots 332 may formed into the material of the fan housing in a radial direction, or slanted toward or against the direction of rotation, or some combination thereof. In FIG. 3A, the slots 332 are formed into the material and are substantially equally spaced and arranged in substantially parallel fashion. In FIG. 3B, the slots 332 are formed to face into the direction of rotation of the fan blades as indicated by the arrow.

In FIG. 3C, the slots 332 have varying width and in particular a varying increasing width (also a decreasing width is possible). In the example shown in FIG. 3C, the slots 332 become wider as one moves away from the blade region (i.e., the air passage region). FIG. 3C shows a magnified portion illustrating the slot widths $w_1$, $w_2$, $w_3$ to be increasing in a stepped fashion. However, in another embodiment the slots can have a sloped shape (not shown). By increasing the slot width, zones of expansion are created which contribute to the reduction of the noise.

Figure 4A:
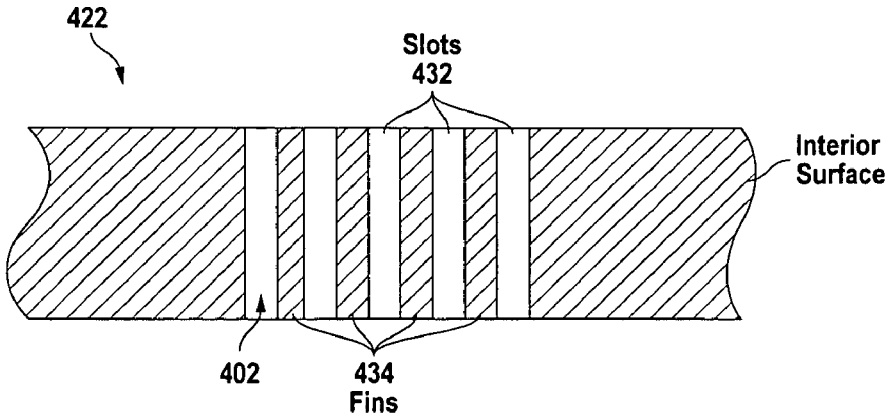
FIGS. 4A to 4C illustrate views of the slot openings formed through the interior surface of the enclosure of the fan housing.
Figure 4B:
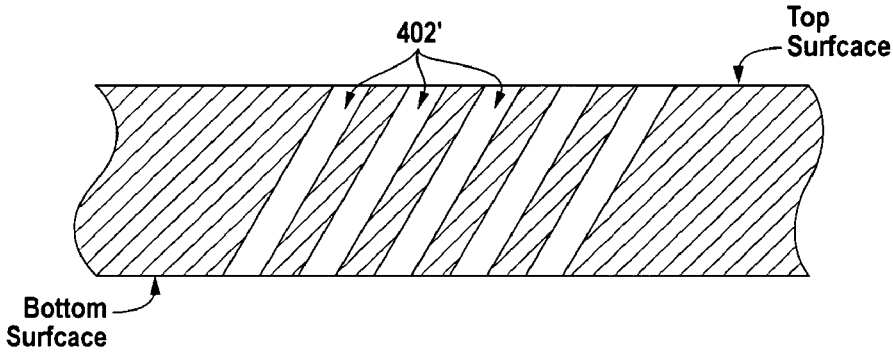

The slots illustrated in FIGS. 1, 1A, 2A, and 2B show substantially vertically oriented slot openings. It is noted, however, that the slot openings need not be vertical. FIG. 4A shows a portion of the enclosure 422 of a fan housing. The figure illustrates a head on view of the slots 432 formed into the interior surface of the enclosure 422, viewed from within the air passage region of the enclosure. The figure shows the fins 434 are substantially vertically oriented (i.e., parallel to the axis of rotation of the fan blades) and in parallel relation to each other. The slot openings 402 are thus vertical. The embodiment illustrated in FIG. 4B shows a configuration where the fins 434 are slanted relative to the axis of rotation, resulting in slot openings 402' that are slanted relative to the axis of rotation. In yet another configuration, the fins 434 may be arranged in a combination of vertical and slanted (slanted right, or slanted left) orientations so that the slot openings are similarly oriented.

Figure 4C:
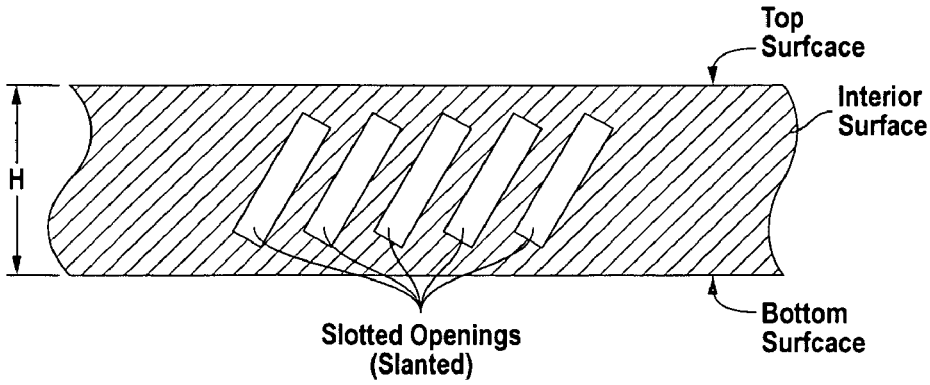

The foregoing embodiments show that the slots extend from the top surface of the enclosure to the bottom surface of the enclosure. The embodiment shown in FIG. 4C shows a variation of the slots. Here, slot openings 402' do not extend the full length from the top surface of the enclosure 422 to the bottom surface of the enclosure. These slots can be formed by drilling through (or otherwise piercing) the interior surface of the enclosure 422 into the material of the enclosure. Alternatively, the slots can be pre-formed by casting them into a top half of the fan housing and into a bottom half of the fan housing, and attaching together the two halves. The figure shows slot openings 402' are formed at an angle (slanted); however, in another embodiment, the slotted openings may be substantially vertical. This construction provides for a more rigid fan housing structure which may be a desirable feature for certain fan applications. Though not shown, the slotted openings can extend through either the top surface or bottom surface of the fan housing, but not through the other surface.

The selection of slot dimensions such as the cross-sectional area of the slot and the slot volume, should include consideration of the blade passing frequency and its higher harmonics. The particular combination of the slot's cross-sectional area and volume affect the acoustic waves from the noise of the blades as they travel into the slots and give rise to a unique set of frequencies that interact with all other frequencies, including the blade passing frequency and its higher harmonics to reduce overall tonal noise. The acoustic frequency components produced by the slots weaken the fundament frequency (blade passing frequency) and higher harmonics.

As described above, the corner regions of the fan housing can be utilized to provide noise suppression means. One such means is to incorporate devices in the volume of space in the corner regions of the fan housing, which are is typically available and unused. For example, small speaker components can be disposed in some of the corner regions and operated in accordance with acoustic cancellation techniques. A properly position microphone (or microphones) can pick up the fan noise. Cancellation software can drive the speakers to provide noise cancellation. Other "devices" might include the use of sound absorbing material in the construction of the fan housing.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A fan comprising:

a fan housing;

an impeller unit disposed within the fan housing; and a fan motor disposed within the impeller unit, the fan housing having an interior circumferential surface, the fan housing further having fins formed in the material of the fan housing through the interior circumferential surface thereof, wherein the fins define slots therebetween, wherein the width of at least one of the slotted openings varies in a stepped fashion.

2. The fan of claim 1 wherein the fins define slots therebetween, wherein slotted openings are formed through the interior circumferential surface.

3. The fan of claim 2 wherein the slotted openings extend through at least a first major surface of the fan housing or a second major surface of the fan housing.

4. The fan of claim 2 wherein the extent of the slotted openings does not reach a top surface of the fan housing nor a bottom surface of the fan housing.

5. The fan of claim 1 wherein the fins are oriented in substantially parallel relation to axis of rotation.

6. The fan of claim 1 wherein the fins are slanted relative to the axis of rotation.

7. The fan of claim 1 wherein at least some of the fins are slanted either against the direction of rotation of the fan blades of the impeller unit or in the direction of rotation of the fan blades of the impeller unit.

8. The fan of claim 1 wherein the fan housing is rectilinear and the fins are disposed in corner portions of the rectilinear housing.

9. The fan of claim 8 wherein the material is a sound absorbent material, including cotton, a rubber-like material, or a foam material.

10. The fan of claim 1 wherein the fan casing is rectilinear and the fins are disposed in surface regions between corner portions of the rectilinear housing.

11. The fan of claim 1 wherein the slotted openings do not penetrate through the outer surface of the fan housing.

12. The fan of claim 1 wherein at least some of the slots are filled with material.

13. A cooling fan comprising:

a fan housing;

an impeller unit disposed within an air passage region of the fan housing; and a fan motor disposed within the impeller unit, the fan housing having an interior circumferential surface, the fan housing further having slots formed into the material of the fan housing and opening into the air passage region through the interior circumferential surface, wherein an interior surface of a first slot has a stepped profile.

14. The fan of claim 13 wherein the slots extend through both a first major surface of the fan housing to a second major surface of the fan housing.

15. The fan of claim 13 wherein the slots extend through a first major surface of the fan housing and not through a second major surface of the fan housing.

16. The fan of claim 13 wherein at least some of the slots are filled with material.

17. The fan of claim 16 wherein the material is a sound absorbent material or a cotton material or a foam material.

18. The fan of claim 13 wherein at least one of the slots is disposed in a corner region of the fan housing or in a side region of the fan housing.

* * * * *

UNITED STATES PATENT AND TRADEMARK OFFICE

CERTIFICATE OF CORRECTION

PATENT NO. : 7,658,592 B1
APPLICATION NO. : 11/640057
DATED : February 9, 2010
INVENTOR(S) : Jarrah et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 438 days.

Signed and Sealed this

Thirtieth Day of November, 2010

David J. Kappos

David J. Kappos
*Director of the United States Patent and Trademark Office*